US005906107A

United States Patent [19]

Takahashi et al.

[11] Patent Number: 5,906,107

[45] Date of Patent: May 25, 1999

[54] AIR CONDITIONER AND CONTROL METHOD OF THE SAME

[75] Inventors: Tomomi Takahashi; Atsushi Itagaki; Hiroki Igarashi, all of Kawasaki, Japan

[73] Assignee: Fujitsu General Limited, Kawasaki, Japan

[21] Appl. No.: 08/848,745

[22] Filed: May 1, 1997

[30] Foreign Application Priority Data

Jul. 19, 1996 [JP] Japan ..... 8-190318
Jan. 31, 1997 [JP] Japan ..... 9-032781

[51] Int. Cl.[6] ..... F28F 27/02; F25B 5/00

[52] U.S. Cl. ..... 62/199; 62/524; 165/101; 165/296

[58] Field of Search ..... 62/524, 525, 199, 62/160; 165/296, 101

[56] References Cited

U.S. PATENT DOCUMENTS 2,139,297 12/1938 Bergdoll ..... 62/524 X
2,169,899 8/1939 Philipp ..... 62/199 X
2,249,856 7/1941 Ruff ..... 62/199 X
3,142,970 8/1964 Hale ..... 62/524 X
5,660,056 8/1997 Arai et al. ..... 62/524 X

*Primary Examiner*—William Wayner
*Attorney, Agent, or Firm*—Kanesaka & Takeuchi

[57] ABSTRACT

An air conditioner comprises a freezing cycle circuit, which includes, successively provided on a main duct line 11 in the mentioned order, a compressor 10, a four-way valve 12, an external heat exchanger 13, a pressure reducer 14, and an internal heat exchanger 11, the main duct line 11 branching into at least an upper and a lower part coolant flow line 20 and 30 in the internal heat exchanger 15, and an on-off valve 10 provided on the upper part coolant flow line 20 and closed in a low capacity cooling operation. The air conditioner can gently cool and gently dry air in a room without causing chillness to be felt.

16 Claims, 14 Drawing Sheets

FIG. 10

A MODE ← 30°C ≦ To

ROOM TEMPERATURE Tr

A ZONE: 4-CODE (18Hz)

Ts

B ZONE: 3-CODE (15Hz)

Ts − 2.0°C

E ZONE: 0-CODE (COMPRESSOR "OFF")

B MODE ← To < 30°C

ROOM TEMPERATURE Tr

A ZONE: 4-CODE (18Hz)

Ts

B ZONE: 3-CODE (15Hz)

Ts − 1.0°C

C ZONE: 2-CODE (12Hz)

Ts − 1.5°C

D ZONE: 1-CODE (9Hz)

Ts − 3.0°C

F ZONE: 0-CODE (COMPRESSOR "OFF")

AIR CONDITIONER AND CONTROL METHOD OF THE SAME

BACKGROUND OF THE INVENTION

1. Field of the Invention

This invention relates to air conditioners and methods of controlling the same. More particularly, the invention relates to techniques concerning an air conditioner, which can provide a gentle cooling mode for gently cooling a room while the temperature thereof is held in the neighborhood of a predetermined temperature, and a gentle drying mode for drying air in the room while substantially maintaining the present temperature of the room, in addition to a cooling mode and a heating mode.

2. Description of the Prior Art

Air conditioners are roughly classified into a separate type in which an interior unit and an exterior unit are separated from each other, and an integral type in which the two units are accommodated in the same housing. In either type, a freezing cycle circuit of heat pump type is provided, in which a compressor, a four-way valve, an integral heat exchanger, a pressure reducer (or an expansion valve) and an internal heat exchanger are successively provided on a main duct line in the mentioned order.

The freezing cycle circuit is used in a heating mode and also a cooling mode by switching its four-way valve. The internal heat exchanger, however, is recently in a trend of increasing a size for improving its heat exchange capacity and reducing the power consumption. The internal heat exchanger also has a coolant heat exchanger with a plurality of branches for increasing the heat exchange efficiency in the cooling operation and also in the heating operation.

Correspondingly, the air conditioner can be set in a plurality of operating modes such as a "strong cooling" mode, an "intermediate cooling" mode, a "weak cooling" mode and a "drying" mode (or commonly termed substantial weak cooling mode).

In the drying mode, intermittent operation of the internal unit fan or like control is provided. Such a measure, however, has a problem that it cannot permit sufficient drying. Another well-known method for drying uses an expansion valve, which is provided on the coolant flow line in the internal heat exchanger and permits drying by re-heating. In this case, however, the coolant flow line cannot be branched. Therefore, the heat exchange efficiency in the cooing and heating operations is inferior to the case where the coolant flow line is branched.

Accordingly, a construction as shown in FIG. 16 is proposed in Japanese Laid-Open Patent Publication No. 8-105646. In this construction, an internal heat exchanger 4 is provided in an internal unit housing 1 such that it faces air suction holes 2 formed in the front wall of the housing 1. A fan 5 is provided adjacent the housing rear wall to take air from the air-conditioned room into the housing through the air suction holes 2 and blow out air having been heat exchanged in the internal heat exchanger 4 through an air blow-out opening 3 provided in the bottom of the housing adjacent the front wall thereof. The internal heat exchanger 4 has a coolant flow line 9, which is branched into a first branch line 9*a* extending upward from the side of a substantially central inlet of the internal heat exchanger 4 and a second branch line 9*b* extending downward. On their outlet side, the two branch lines 9*a* and 9*b* are joined together by a coupler 9*c* provided outside the internal heat exchanger 4. An on-off valve 10 is provided on the second branch 9*b* and closed when a predetermined temperature is approached by the temperature of the air-conditioned room.

In this system, when the temperature of the room becomes the neighborhood of a predetermined temperature during a cooling operation, the on-off valve 10 is turned off, and coolant is allowed to flow through the first branch Line 9*a*. Thus, the cooling air is reduced to one half for gently reducing the temperature in the air-conditioned room. In this operation, drain water produced as a result of condensation in an upper part of the internal heat exchanger 4, falls as drops and is gasified by air passing through a lower part of the internal heat exchanger 4. Therefore, the drying of the room is prevented.

As shown, by the closing of the on-off valve 10 on the second branch line 10 in the neighborhood of the predetermined temperature, a substantial drying effect can no longer be expected due to the gasification of drain in a lower part of the internal heat exchanger 4, although the cooling air output is reduced to one half. For this reason, the on-off valve is opened when drying the room. Therefore, this prior art system still has the problem of excessive reduction of the temperature of the air-conditioned room.

The invention seeks to solve the above problems inherent in the prior art air conditioner. Specifically, it is a first object of the invention to provide an air conditioner, which permits drying of a room without substantially reducing the temperature thereof, i.e., without causing any chillness to be felt, and can improve the comfortability of the room.

A second object of the invention is to provide a method of controlling an air conditioner, which can realize a gentle cooling mode in which the air-conditioned room is dried while holding the temperature thereof in the neighborhood of a predetermined temperature, and also a gentle drying mode in which the room is dried while substantially holding the prevailing temperature.

SUMMARY OF THE INVENTION

To solve the above first object, the invention features an air conditioner, which comprises a freezing cycle circuit including, successively provided on a main duct line in the mentioned order, a compressor, a four-way valve, an external heat exchanger, a pressure reducer, an internal heat exchanger or single heat exchanger array, the main duct line branching into at least an upper part and a lower part coolant flow line in the internal heat exchanger, and an on-off valve provided on the upper part cooling flow line and closed in a low capacity cooling operation.

The low capacity cooling operation is an operation in a state at a reduced operating frequency of the compressor and under an increased pressure in the coolant flow line in the internal heat exchanger, in which only sensible heat is available so that it is impossible to expect substantial cooling (or drying) capacity. According to the invention, in the low capacity cooling operation the on-off valve is closed to allow coolant to flow through the sole lower part coolant flow line. It is thus possible to obtain cooling or drying without spoiling the heat exchange efficiency of the internal heat exchanger, and hence without substantially reducing the temperature of the air-conditioned room.

Besides, since no drain water falls from the upper part of the internal heat exchanger, the blown-out air has not been humidified, and it is possible to provide a dry and comfortable condition with less relative humidity. According to the invention, the cooling operation and drying operation which permits such a dry condition to be obtained while suppressing the chillness, are referred to as gentle cooling operation and gentle drying operation to distinguish them from the conventional cooling and drying operations.

The on-off valve may be provided on a portion of the upper part coolant flow line on the inlet or outlet side thereof. However, in case the on-off valve is provided on the outlet side, its opening would result in stagnation of coolant in the upper part coolant flow line. For this reason, the on-off valve is preferably provided on the inlet side.

In order that the room should not be cooled down excessively when it is gently cooled or gently dried, the upper part coolant flow line preferably has a greater length than the lower part coolant flow line.

When the on-off valve is closed, a temperature difference is produced between air flowing through the upper part of the internal heat exchanger and that flowing in the lower part. In this state, therefore, condensation may occur in a lower end portion of the internal heat exchanger, in which air from the fan and these air streams join together.

According to the invention, the length of a portion of the lower part coolant flow line corresponding to a lower end portion of the internal heat exchanger is made to be less than that of the other portion, thus making the cooling capacity of the lower end portion to be lower than the other portion.

Suitably, a less length portion of the lower part coolant flow line is made up for by leading a portion of the upper part coolant flow line to the lower end of the heat exchanger. By so doing, the heat exchange efficiency is not reduced in the normal cooling and heating operations performed with the on-off valve held open.

To attain the above second object, the invention also features a method of controlling an air conditioner which comprises a freezing cycle circuit including, successively provided on a main duct line in the mentioned order, a compressor, a four-way valve, an external heat exchanger, a pressure reducer, an internal heat exchanger or single heat exchanger array, a controller for controlling the freezing cycle circuit according to signals from a temperature sensor and a predetermined temperature detector, said main duct line branching at least into an upper part and a lower part coolant flow line in the internal heat exchanger, and an on-off valve provided on the upper part coolant flow line and closed in a low capacity cooling operation. The method has a gentle cooling mode for gently cooling a room while the temperature thereof is held in the neighborhood of a predetermined temperature, in addition to a cooling mode and a heating mode, the on-off valve being closed by the controller when the gentle cooling mode is selected.

When the gentle cooling mode is selected, the controller sets a plurality of temperature zones with predetermined temperature ranges with reference to predetermined temperatures, and closes the on-off valve when the temperature of the air-conditioned room is in a gentle cooling temperature zone lower than a predetermined temperature for a redetermined period of time. Suitably, the on-off valve is closed under a further condition that the operating frequency of the compressor is too low to provide the cooling capacity.

In the case where the pressure reducer is an electronic expansion valve, the controller suitably controls the electronic expansion valve to increase the cooling capacity thereof when closing the on-off valve. In the case where the on-off valve is an electromagnetic valve, when the temperature of the air-conditioned room is reduced to be lower than the gentle cooling temperature zone, the controller suitably outputs a compressor stop signal and, after a subsequent predetermined period of time, de-energizes the electromagnetic expansion valve to open the on-off valve. By this control, it is possible to reduce power consumption and prevent heating of the electromagnetic expansion valve.

In this control method, when the temperature of the air-conditioned room has been in a temperature zone higher than a predetermined temperature for a predetermined period of time, the controller opens the on-off valve. As a result, the operating frequency of the compressor is returned to the frequency in the cooling time.

When the air conditioner is in a quick freezing mode, the gentle cooling mode is not brought about until reaching of the neighborhood of the predetermined temperature of the quick cooling mode by the temperature of the air-conditioned room.

To attain the second object, the invention further features a method of controlling air conditioner which comprises a freezing cycle circuit including, successively provided on a main duct line in the mentioned order, a compressor, a four-way valve, an external heat exchanger, a pressure reducer, an internal heat exchanger or single heat exchanger array, a controller for controlling the freezing cycle circuit according to signals from a temperature sensor and a predetermined temperature detector, the main duct line branching at least into an upper part and a lower part coolant flow line in the internal heat exchanger, and an on-off valve provided on the upper part coolant flow line and closed in a low capacity cooling operation. The method has a gentle cooling mode for gently cooling a room while the temperature thereof is held in the neighborhood of a predetermined temperature, and a gentle drying mode for gently drying the room while substantially holding the prevailing temperature thereof, in addition to a cooling mode and a heating mode, the on-off valve being closed by the controller when the gentle cooling mode is selected.

When the gentle drying mode is selected, the controller sets a plurality of temperature zones with predetermined temperature ranges with reference to the temperature of the air-conditioned room at this time and operating frequencies of the compressor for the respective temperature zones, and drives the compressor at the operating frequency for the temperature zone, in which the temperature of the air-conditioned room prevails.

In view of controlling the compressor (for instance detecting the position of the brushless motor), the temperature ranges of the temperature zones and the operating frequencies of the compressor are different with reference to a reference atmospheric temperature. By this method, when the actual atmospheric temperature is higher than the reference atmospheric temperature, the temperature range is wider than that when the actual atmospheric temperature is lower. In view of the compressor control, the operating frequency of the compressor is suitably changed with a temperature zone after a predetermined waiting time.

BRIEF DESCRIPTION OF THE DRAWINGS

FIG. 10 is a view for describing temperature zones which are set in a gentle drying mode in the method of control according to the invention;

DETAILED DESCRIPTION OF THE PREFERRED EMBODIMENT

The above and other features and advantages of the invention will become more apparent from the instant detailed description of the preferred embodiment when the same is read with reference to the accompanying drawings.

Figure 1:
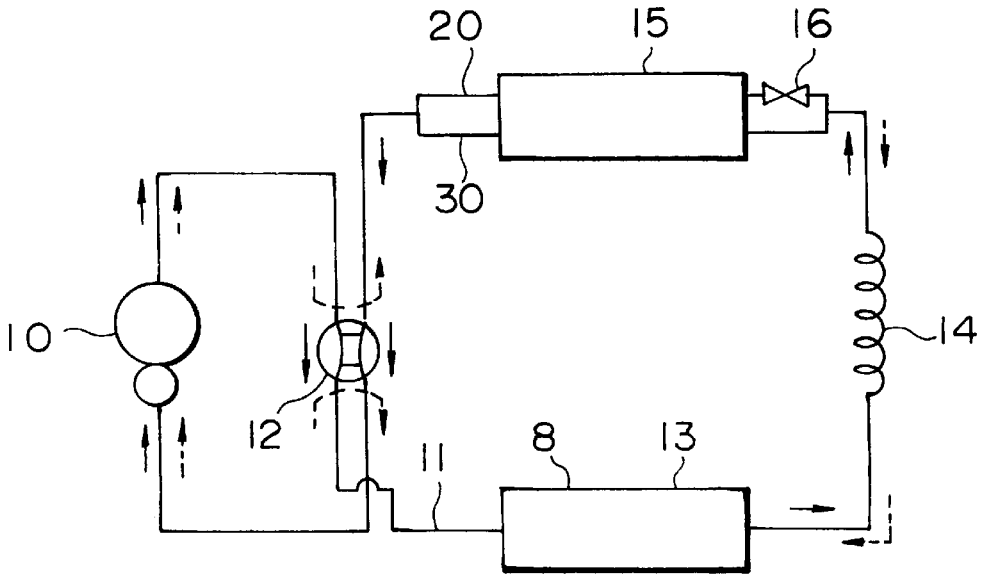
FIG. 1 is a schematic view showing the basic freezing cycle circuit of an air conditioner according to the invention.

FIG. 1 illustrates an air conditioner according to the invention. The air conditioner comprises a compressor 10, across which a freezing cycle circuit is connected. The freezing cycle circuit comprises a main coolant flow line (i.e., main duct line) 11, on which a four-way valve 12 for switching it for cooling and heating, an external heat exchanger 13, a pressure reducer 14, and an internal heat exchanger or single heat exchanger array 15 are connected in the mentioned order.

In the cooling operation, coolant flows through the external heat exchanger 13, the pressure reducer 14 and the internal heat exchanger 15 in the mentioned order as shown by solid arrows. In the heating operation, on the other hand, coolant flows through the internal heat exchanger 15, the pressure reducer 14 and the external heat exchanger 13 in the mentioned order as shown by dashed arrows. The main duct line 11 branches into an upper part coolant flow line 20 and a lower part coolant flow line 30 in in the internal heat exchanger 15.

An on-off valve 16 is provided on the upper part coolant flow line 20. In this embodiment, the on-off valve 16 is provided on the side, from which coolant enters in the cooling operation. However, it is also possible to provide the on-off valve 16 on the side, from which coolant leaves. In this embodiment, the on-off valve 16 is an electromagnetic valve. In the following specification, the on-off valve 10 is described as an electromagnetic valve.

Figure 2:
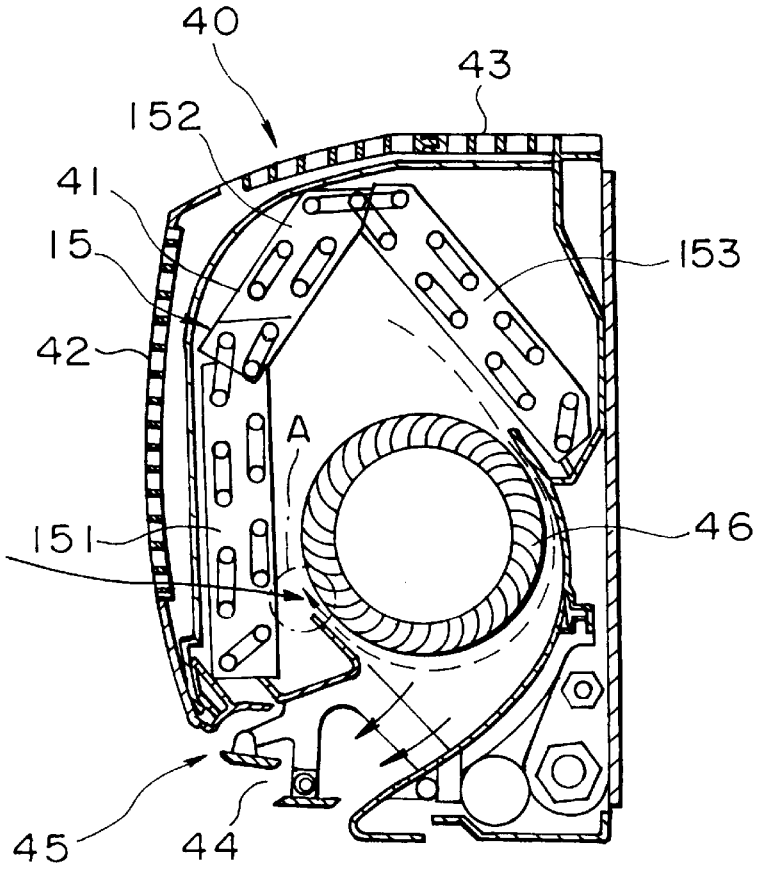
FIG. 2 is a sectional view showing the internal construction of an internal unit according to the invention.
Figure 3:
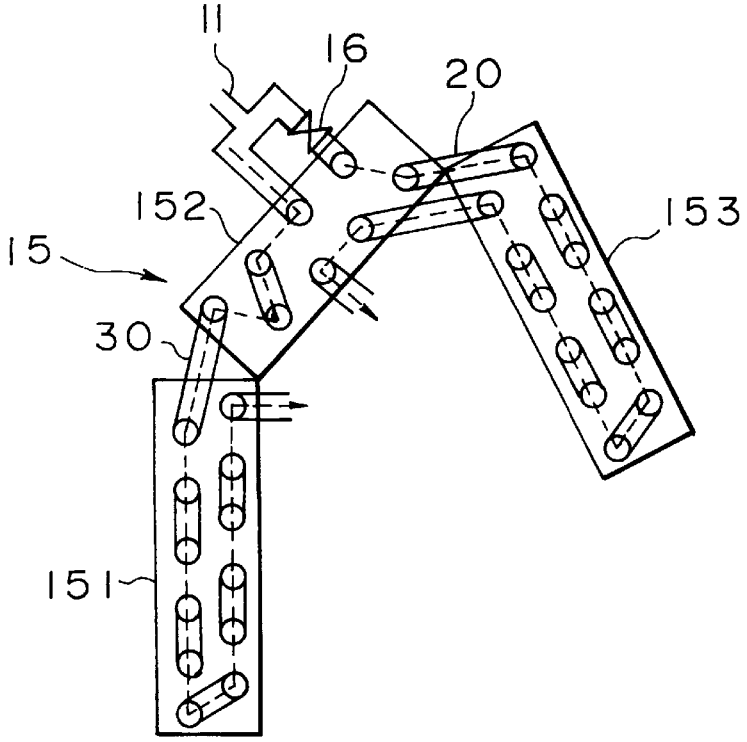
FIG. 3 is a schematic view showing an internal heat exchanger in the internal unit.

FIG. 2 shows the internal construction of an internal unit 40, in which the internal heat exchanger 15 is accommodated. FIG. 3 shows the internal heat exchanger 40 removed from the internal unit 15.

The internal unit 40 has a substantially rectangular housing 41. The front wall and ceiling of the housing 41 have front and top air suction holes 42 and 43 for taking in air. The internal heat exchanger 15 is disposed in the housing 41 of the internal unit 40 such that it extends along the front and top air suction holes 42 and 43. For reducing the size of the housing 41, the fins of the internal heat exchanger 15 are provided in three fin groups.

More specifically, the internal heat exchanger 15 has a first fin group 151 which faces the front air suction holes 42, a second fin group 152 which extends obliquely upward from the upper end of the first fin group 151 to face substantially central ones of the top air suction holes 152, and a third fin group 153 which extends obliquely downward form the upper end of the second fin group 152 to the rear wall of the housing 41. The second and third fin groups 152 and 153 are in the form of an inverted letter V.

As shown in FIG. 3, the main duct line 11 branches into two branches at a position substantially corresponding to a central portion of the second fin group 152. One of the branches extends as an upper part coolant flow line 20 from the second fin group 152 through the third fin group 153. An electromagnetic valve 16 is provided on the upper part coolant flow line 20 near the branching point thereof.

The other branch extends as a lower part coolant flow line 30 through the first fin group 151. Outlet portions of the two coolant flow lines 30 and 40 join together on the outside of the internal heat exchanger 15 and returned to the four-way valve 12. As shown in FIGS. 2 and 3, the upper part coolant flow line 20 has a greater length than the lower part coolant flow line 30.

The housing 41 has an air blow-out opening 45 at the bottom corner adjacent the front wall. An air directing plate 44 is rotatably mounted in the opening 45. A fan 46 is disposed in the air passage leading from the internal heat exchanger 15 to the air blow-out opening 45. By the fan 46 air in the room is taken in the housing 41 through the front and top air suction holes 42 and 43 for heat exchange in the internal heat exchanger 15 and then led out through the air blow-out opening 45.

When the room is cooled down to reach the neighborhood of a predetermined temperature, a controller reduces the operating frequency of the compressor 10 and thus brings about a capacity cooling operation. At this time, the electromagnetic valve 16 is closed to permit coolant to flow through the sole lower part coolant flow line 30, whereby the room can be cooled or dried without spoiling the heat exchange efficiency of the internal heat exchanger 15, and thus without substantially reducing the temperature of the room.

Besides, according to the invention no drain water is dropped from the second and third fin groups 152 and 153 in the internal heat exchanger 15. Thus, the blown-out air has not been humidified, and it is possible to obtain a dry and comfortable condition with less moisture.

The closing of the electromagnetic valve 16 gives rise to a temperature difference between air flowing through the second and third fin groups 152 and 153 in the upper part of the internal heat exchanger 15 and air flowing the first fin group 151 in the lower part. Therefore, condensation may occur in a lower end portion A of the internal heat exchanger 15 where air forced by the fan 46 and the air streams join together.

A basic idea for preventing this is to make the duct line length (or duct line density) of the lower part coolant flow line 30 on the side of the lower end of the internal heat exchanger 15 less than that of the remaining coolant flow line, thus reducing the cooling capacity in the lower end portion A compared to that in the remaining portion. With this arrangement, however, the heat exchange efficiency of the internal heat exchanger 15 as a whole is inevitably reduced in the cooling or heating operation in the open state of the electromagnetic valve 16.

Figure 4:
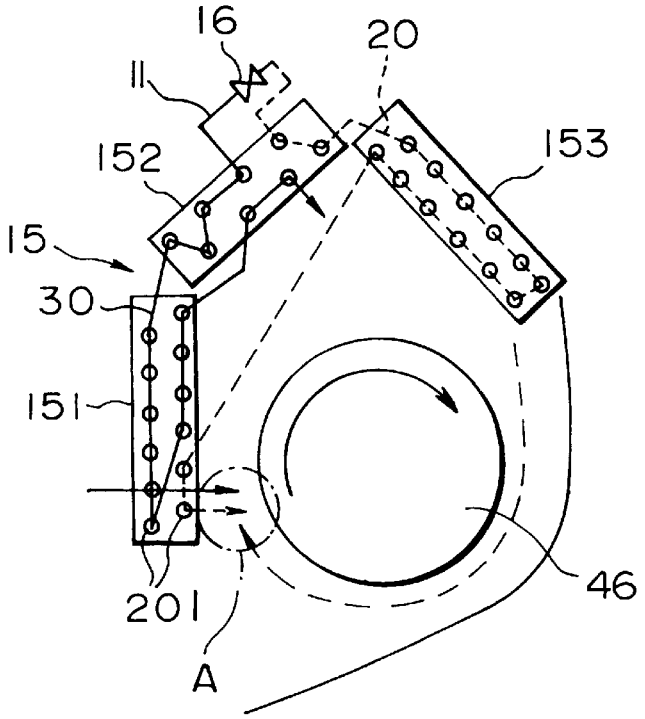
FIG. 4 is a schematic view showing a modification of the internal heat exchanger.

According to the invention, as shown in FIG. 4, the reduced duct line length portion of the lower part coolant flow line 30 is made up for by leading a portion 201 of the upper part coolant flow line 20 to the side of the lower end of the first fin group 151. With this arrangement, in the open state of the electromagnetic valve 16 the entire internal heat exchanger 15 contributes to the heat exchange, and the heat exchange capacity in the normal cooling and heating operations is not reduced.

Figure 5:
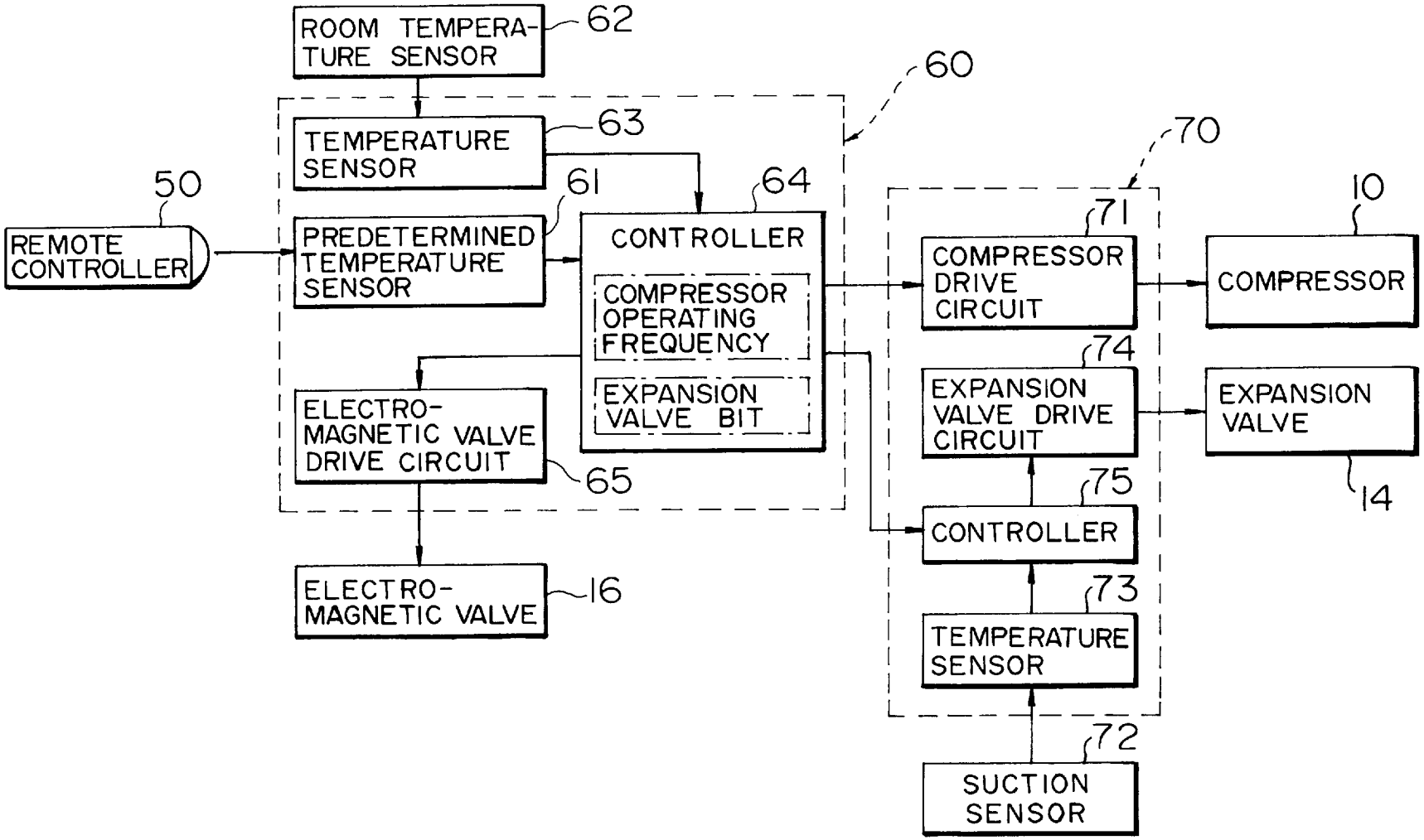
FIG. 5 is a block diagram showing the basic circuit of the air conditioner according to the invention.

The method of controlling the air conditioner in the gentle cooling mode and also gentle drying mode will be described. FIG. 5 is a block diagram showing the basic control of the air conditioner. In this embodiment, various operating modes and redetermined temperatures can be set by a remote controller 50. Reference numeral 60 designates a control unit, which includes a predetermined temperature sensor 61 for receiving signals from the remote controller 30, an actual temperature detector 63 for receiving an actual temperature signal from an room temperature sensor 62, a central controller 64 in the internal unit for executing various control routines according to the received signals, and an electromagnetic valve drive circuit 65 for on-off driving the electromagnetic valve 16.

The central controller 64 is a CPU (central processing unit) or an MPU (microprocessor), and it sets operating frequencies of the compressor 10 and an expansion valve bit for controlling the pressure reducer (or electronic expansion valve) 14 according to the signals from the predetermined and room temperature sensors 61 and 62.

Reference numeral 70 designates an external unit controller, which includes a compressor drive 71 for driving the compressor 10 according to a compressor operating frequency signal from the internal unit central controller 64, a suction temperature sensor 73 for receiving a compressor suction side temperature signal from a suction sensor 72, an expansion valve drive circuit 74 for driving the pressure reducer (or electronic expansion valve) 14, and an external unit side central controller 75 for controlling the expansion valve drive circuit 74 according to a temperature signal from the suction temperature sensor 73 and an expansion valve bit signal from the internal unit side central processor 64.

Figure 6:
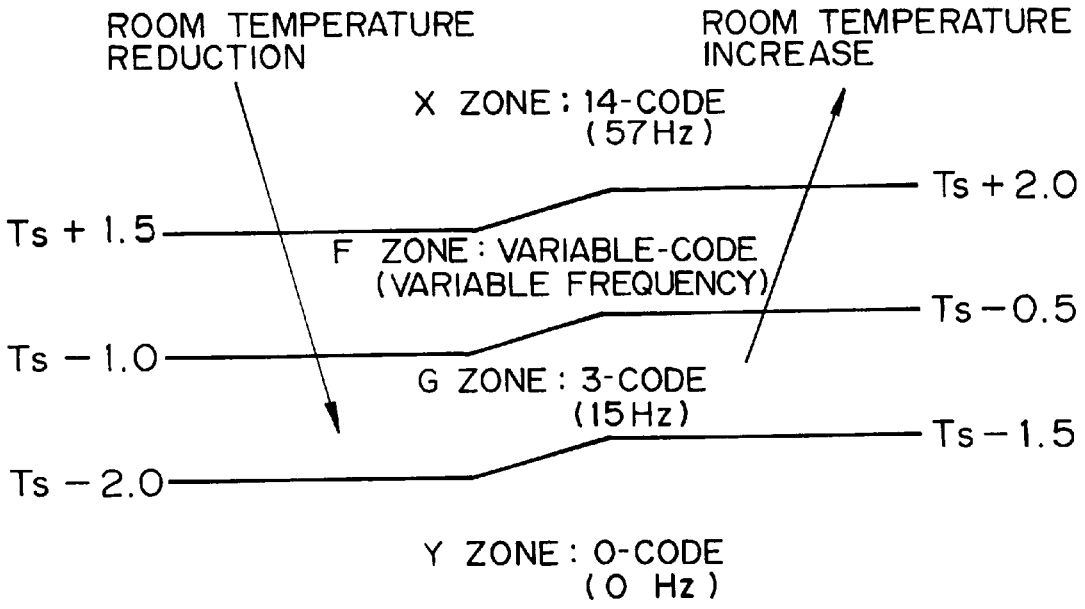
FIG. 6 is a view for describing temperature zones which are set in a gentle cooling mode in the method of control according to the invention.
Figure 7:
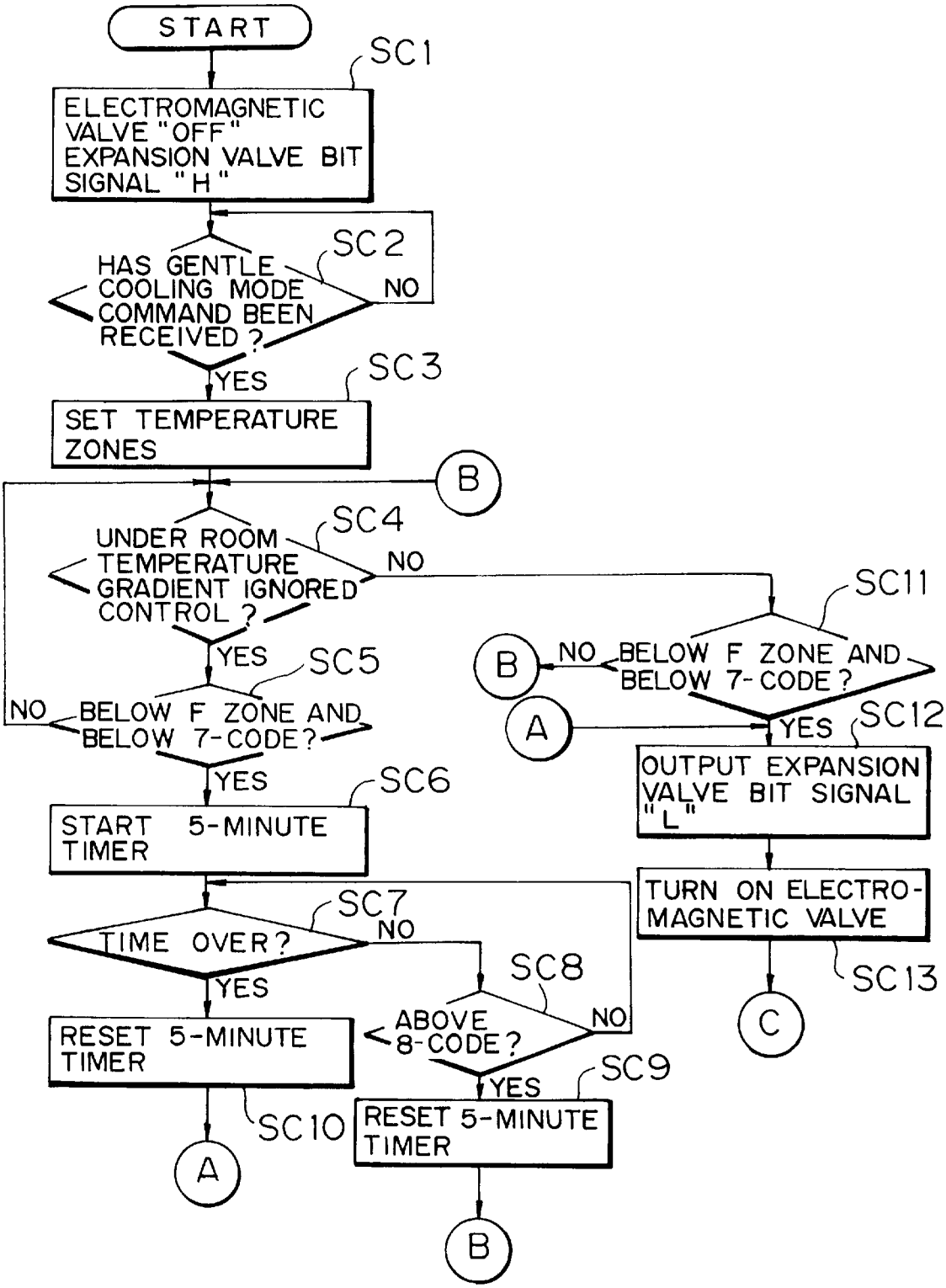
FIGS. 7 and 8 are flow charts illustrating a routine in the gentle cooling mode.
Figure 8:
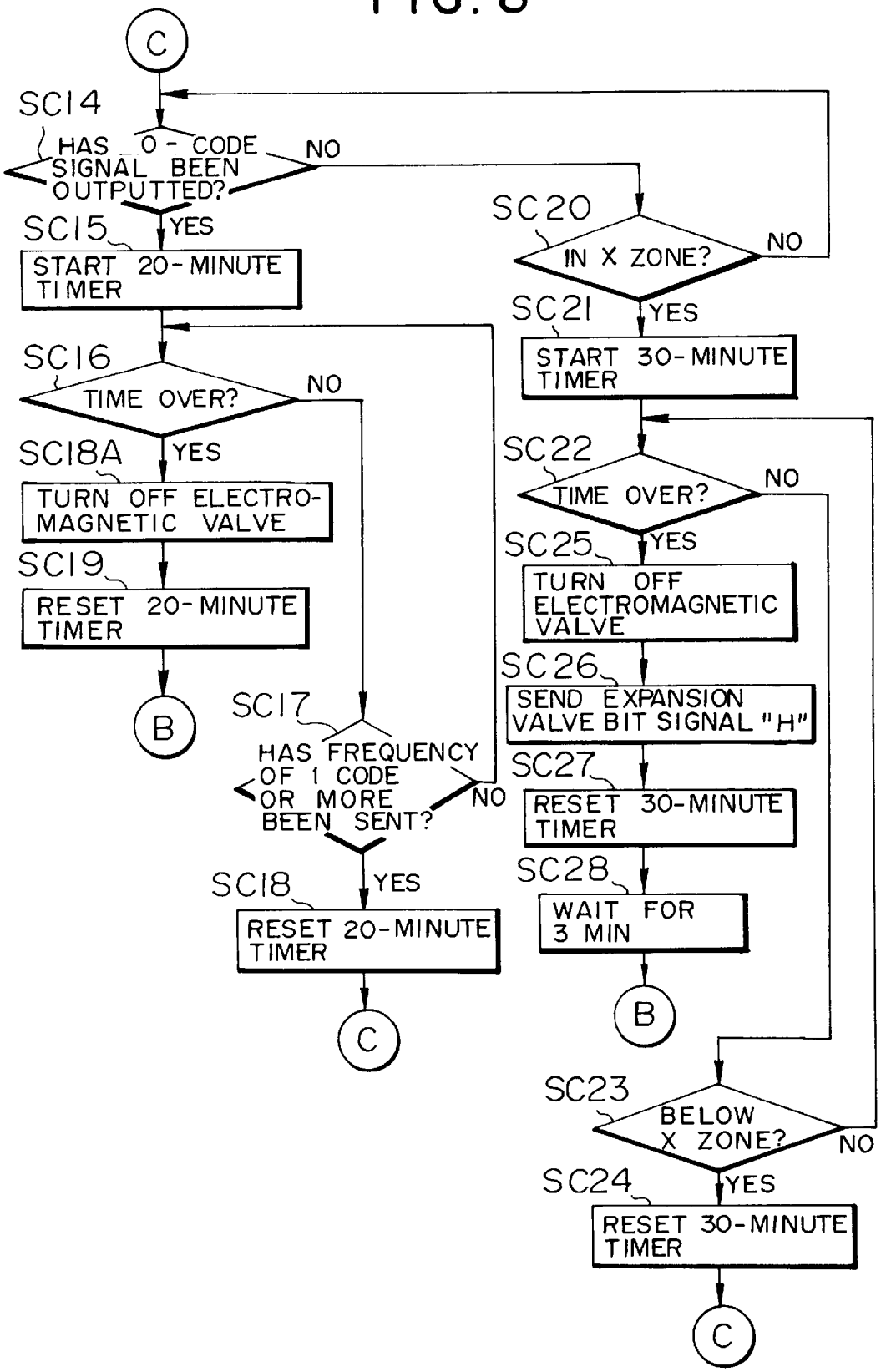

FIGS. 7 and 8 are flow charts illustrating a routine in the cooling operation. In the normal cooling mode, in a step SC1 the internal unit side central controller 64 sets the electromagnetic valve 10 to be "OFF" and also sets the expansion valve bit signal to be "H". Then, in a step SC2 it checks whether a gentle cooling mode command from the remote controller 50 has been received. When this command has been received, the central controller 64 sets temperature zones for room temperature control and compression operating frequencies for these temperature zones, as shown in FIG. 6, with reference to the predetermined temperature Ts represented by the output of the predetermined temperature sensor 61 (step SC3).

In this embodiment, when the temperature of the air-conditioned room is being reduced, a temperature range above Ts+1.5 is set as X zone (14-code signal, operating frequency: 57 Hz), a temperature range between Ts and Ts−1.0 is set as F zone (variable code signal from 4- to 13-code signal, operating frequency: various Hz), a temperature range between Ts−1.0 and Ts−2.0 is set as G zone (3-code signal, operating frequency: 15 Hz), and a temperature range below Ts−2.0 is set as Y zone (0-code signal, operating frequency: 0 Hz).

When the temperature of the room is being increased, a temperature range above Ts+2.0 is set as X zone, a temperature range between Ts+2.0 and Ts−0.5 is set as F zoine, a temperature range between Ts−0.5 and Ts−1.5 is set as G zone, and a temperature range below Ts−1.5 is set as Y zone. The operating codes and operating frequencies of the compressor are the same as those when the temperature of the air-conditioned room is being reduced.

In a subsequent step SC4, the central controller 64 checks whether the air conditioner is under a room temperature gradient ignored control or commonly termed quick cooling control. When the result of the check is "YES", it executes a step SC5 of checking whether the temperature of the air-conditioned room is below F zone and also the operating frequency of the compressor 10 is, for instance, below 7-code. When the result of the check is "NO", the central controller 64 goes back to the step SC4. When the result of the check is "YES", it executes a step SC6 of starting a 5-minute timer.

Then, until it finds in a step SC7 that 5 minutes has passed, the central controller 64 executes a step SC8 of checking whether the operating frequency of the compressor 10 has increased to be above 8-code. When the result of the check is "YES", i.e., when the frequency has increased, the central controller 64 executes a step SC9 of resetting a 5-minute timer and then goes back to the step SC4. In the above way, when the gentle cooling mode is brought about during the quick cooling operation, the state in which the temperature of the air-conditioned room is below F zone and the operating frequency of the compressor 10 is below 7-code, is continued for 5 minutes.

When 5 minutes has passed without increase of the operating frequency of the compressor 10 beyond 8-code, the central controller 64 executes a step SC10 of resetting the 5-minute timer and then jumps to a step SC12 of outputting an electromagnetic valve bit signal of "L" to the electromagnetic valve drive circuit 65 and the external unit central controller 75. Then in a step SC13, it turns on, i.e., "closes", the electromagnetic valve 16, thus allowing coolant to flow the sole lower part cooling flow line 30. On the external unit side, the expansion valve drive circuit 74 enhances the capacity of the electromagnetic expansion valve 14 to bring about a gentle cooling operation.

When it is found in the step SC4 that the result of the check is "NO", i.e., the air conditioner is not under quick cooling control, the central controller 64 executes a step SC11, in which as in the step SC5 it checks whether the temperature of the air-conditioned room is below F zone and the operating frequency of the compressor 10 is below 7-code. When the result of the check is "YES", the central controller 64 outputs an expansion valve bit signal of "L" to control the electronic expansion valve 14. When the result of the check is "NO", it returns to the step SC4.

When the temperature of the air-conditioned room is reduced down to Y zone in the gentle cooling operation, the central controller 64 outputs a 0-code signal for stopping the compressor 10 to the compressor drive 71. When this signal is detected in a step SC15, it executes a step SC15 of starting a 20-minute timer and then executes a step SC17 until it detects in the step SC16 that 20 minutes has passed. In the step SC17, it checks whether an operating frequency of one code or more has been sent. When the result of the check in the step SC17 is "YES", i.e., when a frequency of one code or more has been sent, it executes a step SC18 of resetting the 20-minute time and returns to the step SC14. When any operating frequency of one code or more has not been sent in the 20 minutes, it executes a step SC18A of turning off, i.e., "open", the electromagnetic valve 16, then executes a step SC19 of resetting the 20-minute timer, and goes back to the step SC4.

When the result of the check in the step SC14 is "NO", i.e., when no 0-code signal has been sent, the central controller 64 executes a step SC20 of checking whether the temperature of the air-conditioned room has increased up to X zone. When the result of the check is "NO", it returns to the step SC14. When the result of the check is "YES", it executes a step SC21 of starting a 30-minute timer. Then, until it detects in a step SC22 that 30 minutes has passed, it checks whether the temperature of the air-conditioned room has been reduced to be below X zone (step SC23). When the result of the check is "YES", it executes a step SC24 of resetting the 30-minute timer and then returns to the step SC14.

When it detects in the step SC22 that time has been over without reduction of the temperature of the air-conditioned room to be below X zone, the central controller 64 executes a step SC25 of turning off, i.e., "open", the electromagnetic valve 16 and then executes a step SC26 of sending expansion valve bit signal of "H" to the electromagnetic valve drive circuit 65 and the external unit central controller 76. In a subsequent step SC27, it resets the 30-minute timer. Then it executes a step of waiting for 3 minutes and then returns to the step SC4.

Figure 9:
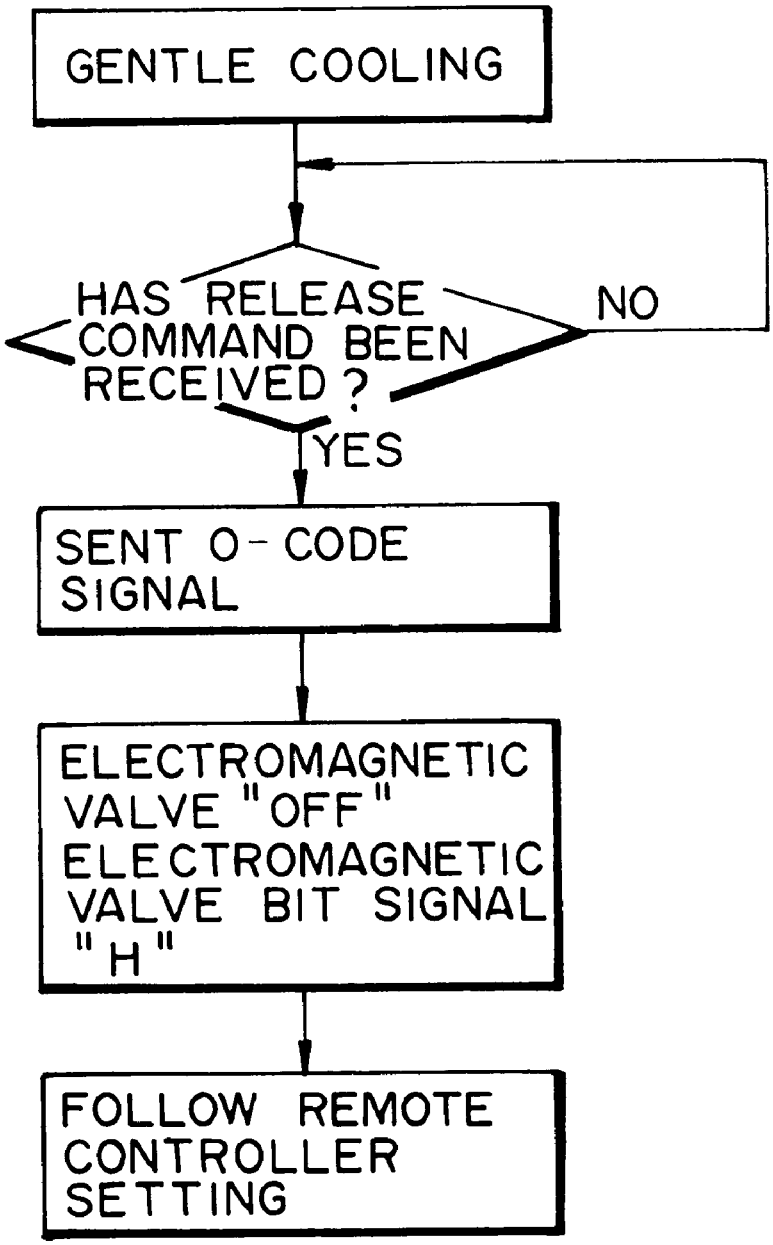
FIG. 9 is a flow chart illustrating a routine when releasing the gentle cooling mode.

When a gentle cooling mode release command is sent from the remote controller 50, the central controller executes a routine as shown in FIG. 9. Specifically, it sends a 0-code signal for stopping the compressor 10 to the compressor drive 71. Then, it turns off the electromagnetic valve 16 and sets the expansion valve bit signal to "H", and then executes operation according to the setting of the remote controller 50.

The operation in the gentle drying mode will now be described. As shown in the flow chart of FIG. 11, in a step SD2 before section of the gentle drying mode, the central controller 64 turns off the electromagnetic valve 16 and sets the expansion valve bit signal to "H".

Then it executes a step SD2 of checking whether gentle drying mode command from the remove controller has been received. When the command has been received, the central controller 64 executes a step SD3 of sending expansion valve signal of "L" to the electromagnetic valve drive circuit 65 and the external unit central controller 75. Then, in a step SD4 it sets temperature zones for room temperature control and compressor operating frequencies for these temperature zones, as shown in FIG. 10, according to the temperature Tr of the air-conditioned room as detected by the temperature detector 63 and the atmospheric temperature To.

In this embodiment, the predetermined temperature Ts is set to Ts=Tr−1.0, and when the atmospheric temperature To is higher than 30° C., a temperature above Ts is set as A zone (4-code, operating frequency: 18 Hz), a temperature range between Ts and Ts−2.0 is set as B zone (3-code, operating frequency: 15 Hz), and a temperature range below Ts−2.0 is set as E zone (0-code, compressor: "off").

When the atmospheric temperature To is lower than 30° C., B mode is provided, and a temperature range above Ts is set as A zone (4-code, operating frequency: 18 Hz), a temperature range between Ts and Ts−1.0 is set as B zone (3-code, operating frequency: 15 Hz), a temperature range between Ts−1.0 and Ts−1.5 is set as C zone (2-code, operating frequency: 12 Hz), a temperature range between Ts−1.5 and Ts−3.0 is set as D zone (one code, operating frequency: 9 Hz), and a temperature range below Ts−3.0 is set to F zone (0-code, compressor: "off").

In a subsequent step SD5, the central controller 64 checks whether the gentle drying mode command input is the first one. When the result of the check is "YES" (first one), it executes a step SD6 of starting a 3-minute timer. Then, in a step SD7 it sends a 3-code signal for setting the operating frequency of the compressor 10 to 15 Hz to the compressor drive 71.

In a subsequent step SD8, the central controller 64 turns on, i.e., "closes", the electromagnetic valve 16, and then jumps to a step SD11. The 3-minute timer is started in the step SD6 because the waiting time for switching each temperature zone is set to 3 minutes.

When the result of the check in the step SD5 is "NO", the central controller 64 checks whether the compressor 16 is "ON" in the step SD9. When the compressor is "ON", it executes the next step SD10 of detecting the atmospheric temperature, setting a temperature zone corresponding to the detected atmospheric temperature, and starting a 3-minute timer.

Figure 12:
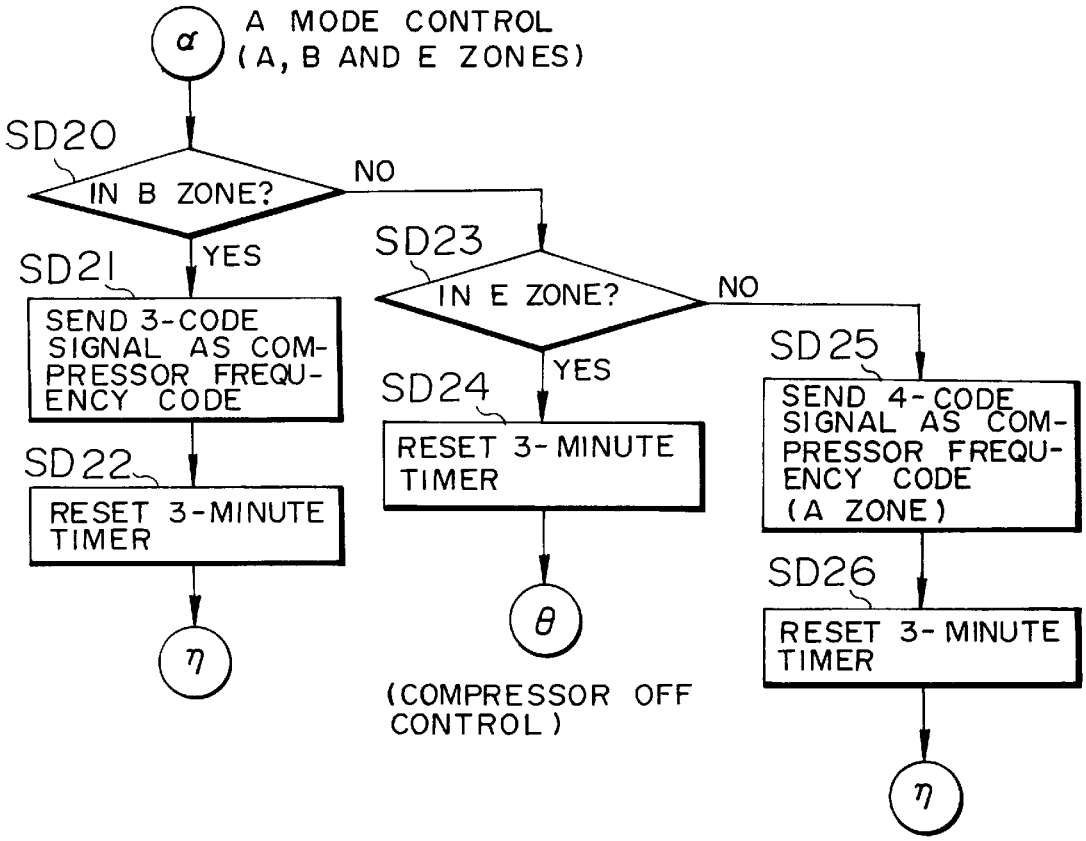

When it confirms in a subsequent step SD11 that 3 minutes has passed, the central controller 64 detects the atmospheric temperature again and in a next step SD13, it is checked whether the temperature zone is of B mode. When the result of the check is "NO", an A mode control in a step SD20 and following steps in FIG. 12 is executed.

Figure 13:
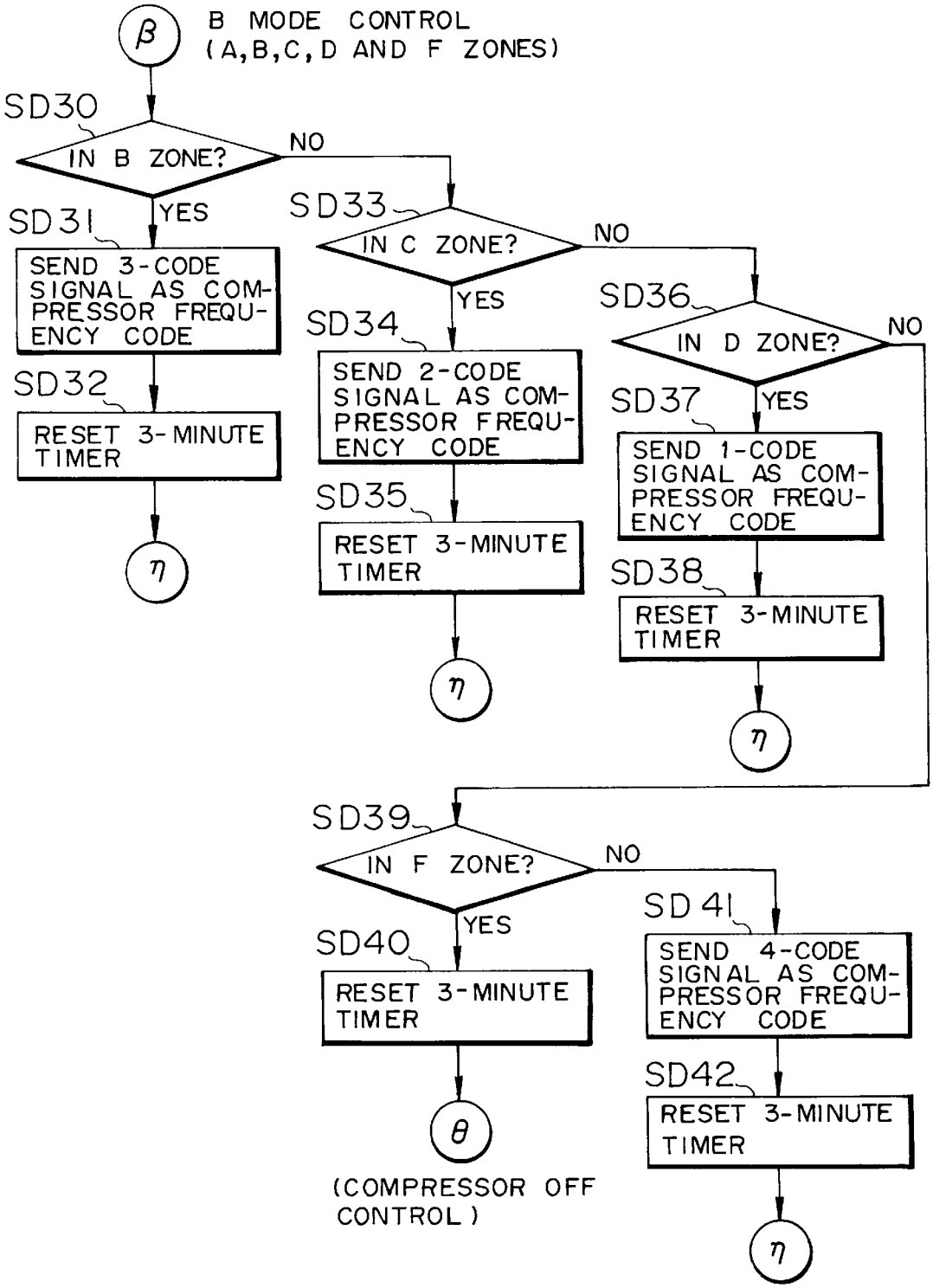

When the result of the check in the step SD13 is "YES" (B mode), the central controller 64 executes a step SD14 of checking whether the operation has been in B mode continuously for 30 minutes. When the result of the check is "NO", the central controller 64 executes an A mode control in the step SD20 and following steps in FIG. 12. When the result of the check is "YES", it executes a B mode control as shown in FIG. 13.

In the A mode control, in a step SD20 the central controller 64 checks whether the operation is in B mode. When the result of the check is "YES", it executes a step SD21 and sends a 3-code signal to set the operating frequency of the compressor 10 to 15 Hz. Then, it executes a step SD22 of resetting the 3-minute timer and returns to the step SD9.

When the result of the check in the step is "NO", it executes a step SD23 of checking whether the temperature is in E zone. When the result of the check is "YES", it executes a step SD24 of resetting a 3-minute timer and turns off the compressor 10. When the result of the check in the step SD23 is that the temperature is not in E zone, the central controller 64 sends a 4-code signal to set the operating frequency of the compressor 10 to 18 Hz of A zone. Then, it executes a step SD26 of resetting the 3-minute timer and returns to the steep SD9.

In the B mode control, the central controller 64 first executes a step SD30 of checking whether the temperature is in B zone. When the result of the check is "YES", it executes a step SD31 of sending a 3-code signal to set the operating frequency of the compressor 10 to 15 Hz. Then, it executes a step SD32 of resetting the 3-minute timer and returns to the step SD9.

When the result of the check in the step SD30 is "NO", the central controller 64 sends a 2-code signal to set the operating frequency of the compressor 10 to 12 Hz at a step SD34 through a step SD33. Then, it executes a step SD35 of resetting a 3-minute timer and returns to the step SD9.

When the result of the check in the step SD33 is "NO", the central controller 64 checks whether the temperature is in D zone. When the result of the check is "YES", it executes a step SD37 of sending a 1-code signal and sets the operating frequency of the compressor 10 to 9 Hz. Then, it executes a step SD38 of resetting a 3-minute time and returns to the step SD9.

When the result of the check in the step SD36 is "NO", the central controller 64 executes a step SD39 of checking whether the temperature is in F zone. When the result of the check is "YES", it executes a step SD40 of resetting a 3-minute timer and turns off the compressor 10. When it does not judge in the step SD39 that the temperature is in F zone, it executes a step SD41 of sendng a 4-code signal to set the operating frequency of the compressor 10 to 18 Hz of A zone. Then, it executes a step SD42 of resetting a 3-minute timer and returns to the step SD9.

Figure 11:
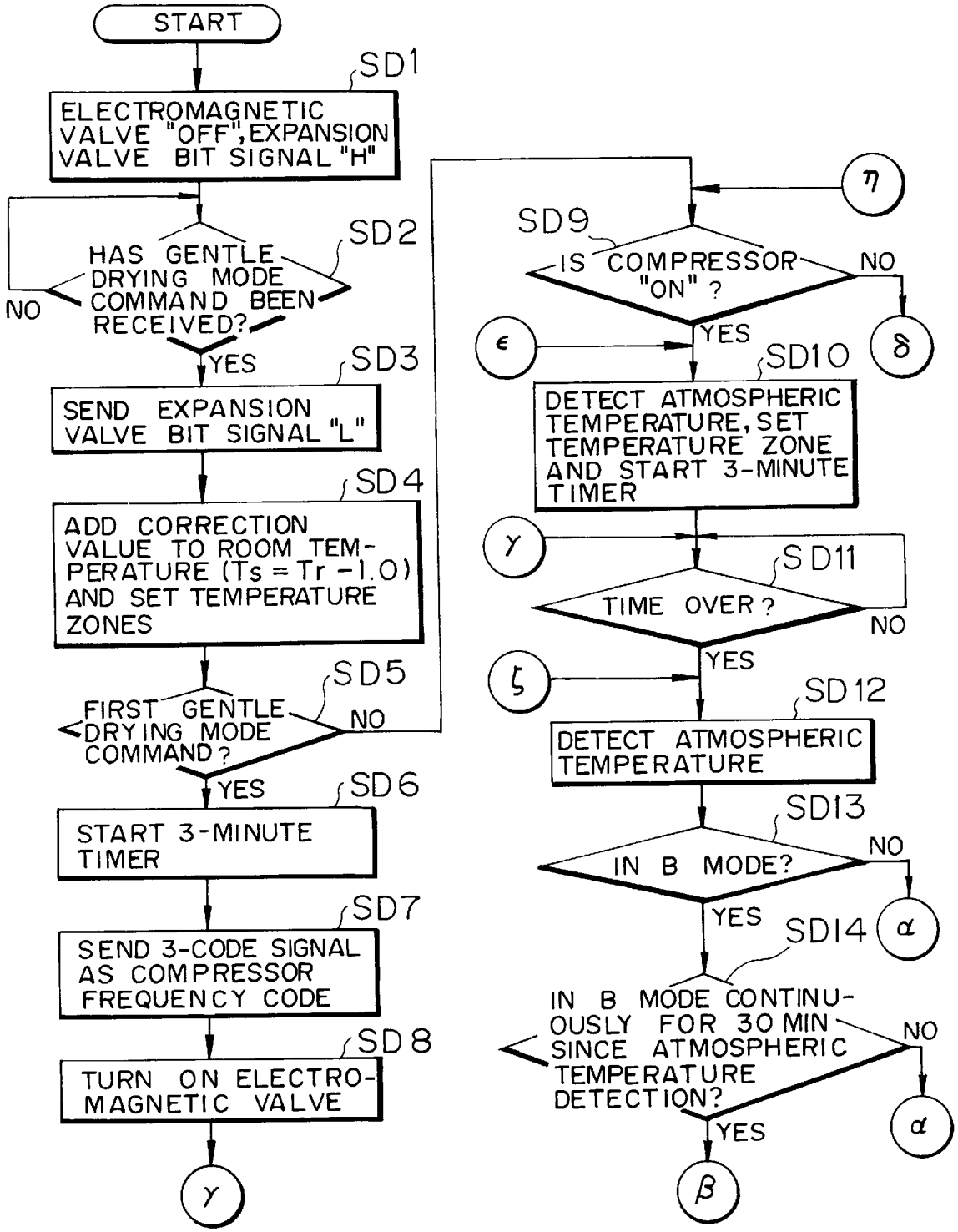
FIGS. 11 to 15 are flow charts illustrating a routine in the gentle drying mode.
Figure 14:
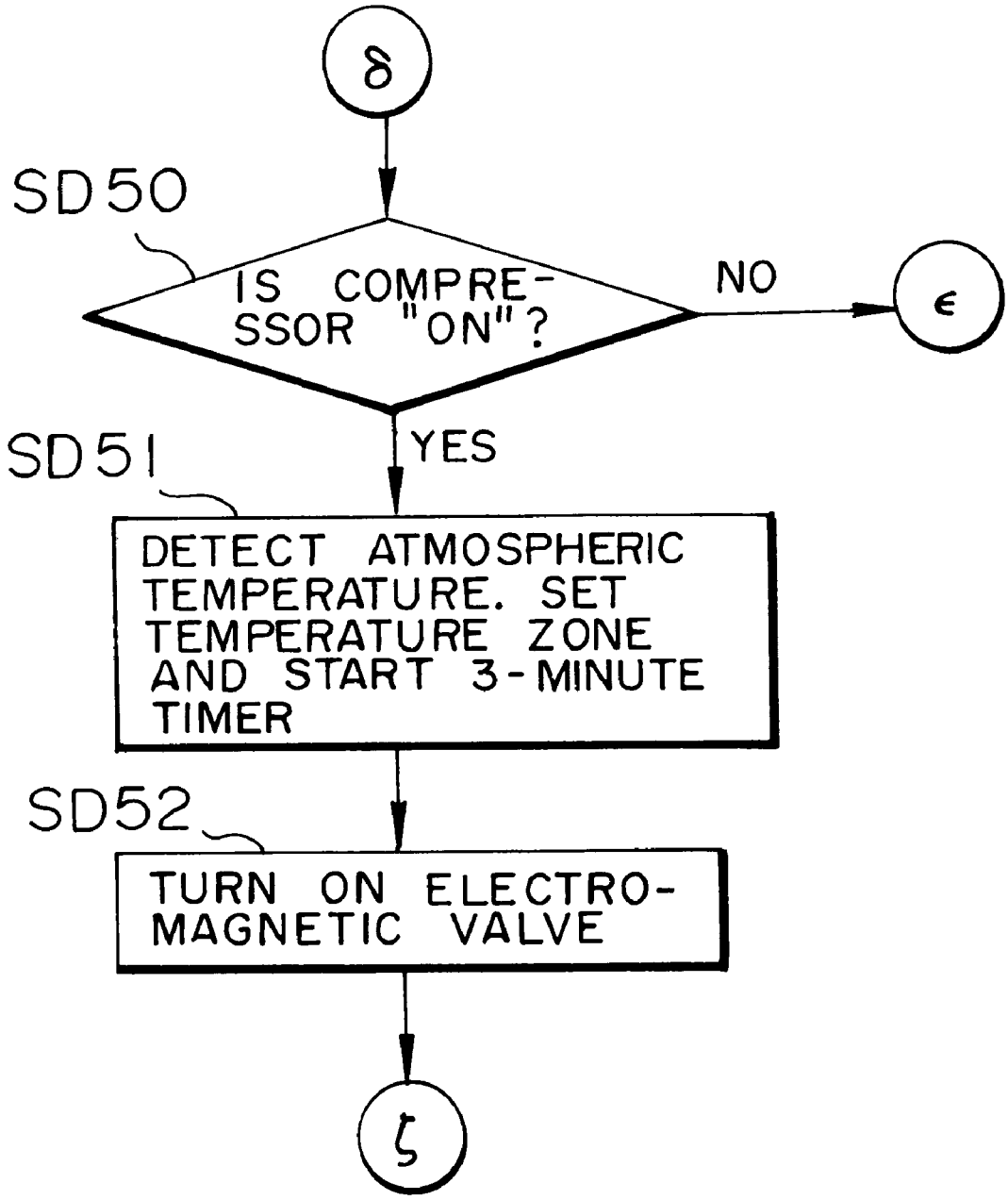

When the central controller 64 does not judge in the step SD9 in FIG. 11 that the compressor 10 is "ON", it executes a step SD50 shown in FIG. 14 of checking whether the compressor 10 is "ON". When the result of the check is still "NO", it returns to the step SD10. When the compressor 10 is "ON", it executes a step SD51 of detecting the atmospheric temperature, sets a temperature zone corresponding to the detected atmospheric temperature and starts a 3-minute timer. Then, it executes a step SD52 of turning on, i.e., "open", the electromagnetic valve 16 and returns to the step SD12.

Figure 15:
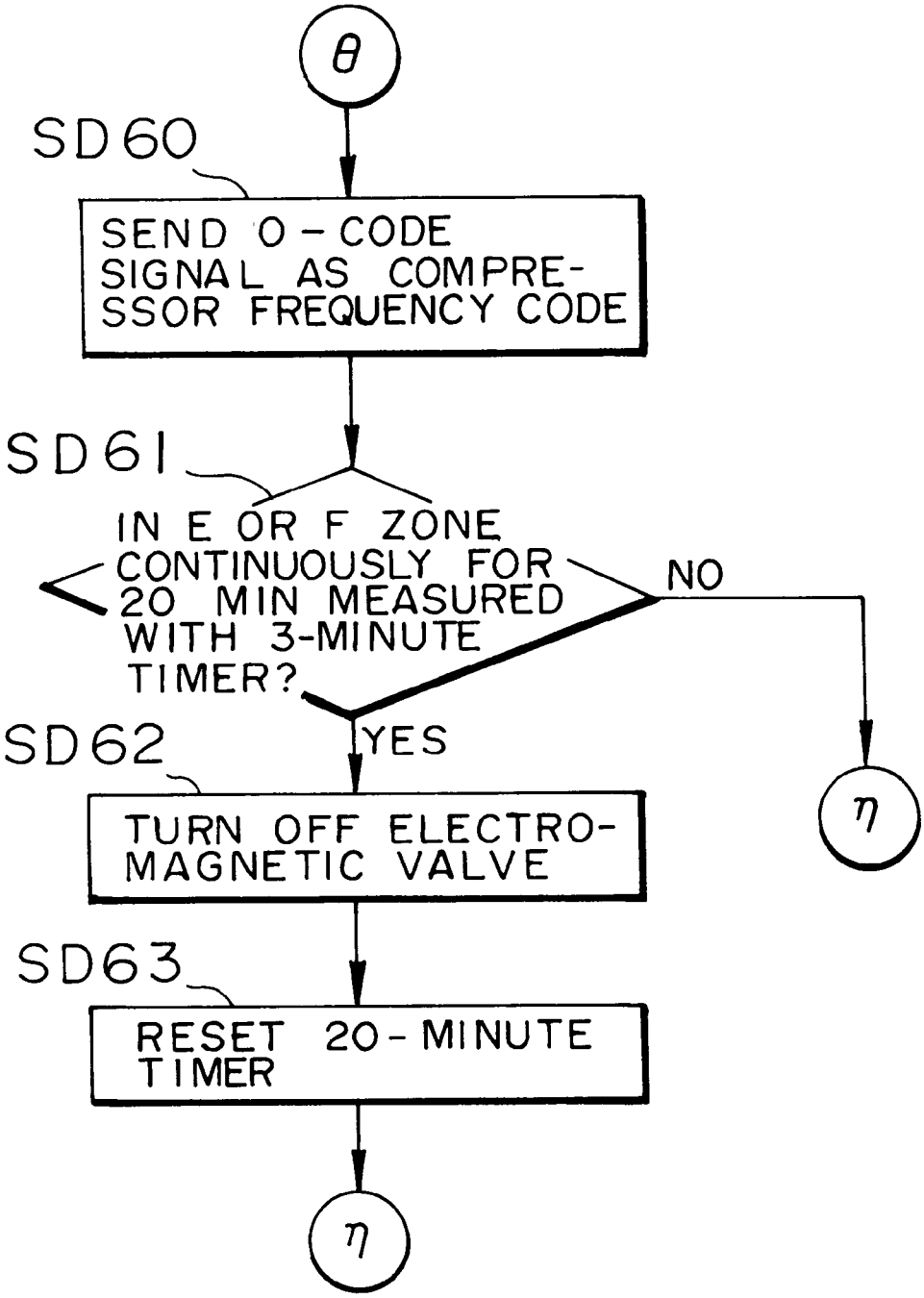
Figure 16:
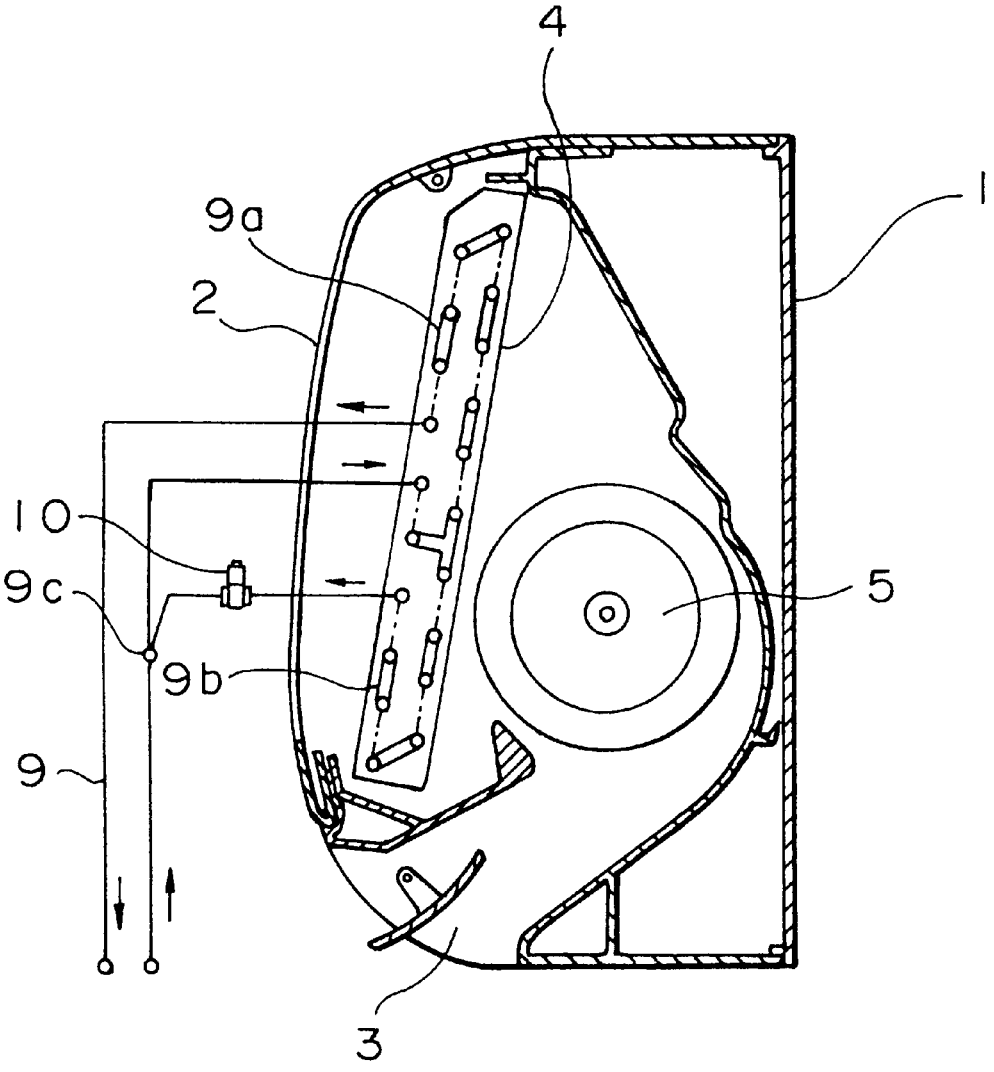
FIG. 16 Prior Art
FIG. 16 is a sectional view showing the internal construction of an internal unit in an air conditioner according to the invention.

FIG. 15 shows a control when turning off the compressor 10 in the case of E zone in the A mode control and also in the case of F zone in the B mode control. The central controller 64 first executes a step SD60 turning off the compressor 10 and sends a 0-code signal and then a step SD61 of checking whether the temperature is in E or F zone for a predetermined period of time (in this embodiment 20 minutes as timer period of the 30-minute timer).

When the result of the check is "NO", it returns to the step SD9. When the result of the check is "YES", it executes a step SD62 of turning off, i.e., "open", the electromagnetic valve 16 and then a step SD63 of resetting the 20-minute timer and returns to the step SD9.

The gentle drying mode is released in the manner as described before in connection with the flow chart of FIG. 9 in response to the reception of an end command from the remote controller.

As shown above, in the gentle drying mode according to the invention, the air-conditioned room can be dried without substantially reducing the temperature of the room art the time when the command of this mode is received. This is particularly effective in such case as when one goes to bed, and it is possible to realize healthy drying of the room while suppressing chillness.

As has been described in the foregoing, according to the invention in the commonly termed weak cooling operation that is brought about with the compressor operating frequency reduction, coolant is allowed to flow through the sole lower part coolant flow line. It is thus possible to cool or dry the room without spoiling the heat exchange efficiency of the internal unit heat exchanger, and hence without substantially reducing the temperature of the room. Again in this case, no drain water falls from the upper part of the internal unit heat exchanger. Thus, the blown-out air has not been humidified, and it is possible to obtain a dry and comfortable condition with less relative humidity.

In the gentle cooling mode, a temperature zone is set with reference to the pertinent predetermined temperature, and this temperature zone is held in the cooling operation. It is thus possible to obtain cooling such that no chillness is felt.

In the gentle drying mode control, the temperature zone is selected with reference to the prevailing temperature of the air-conditioned room. Thus, drying can be obtained without further reduction of the temperature to be lower than the gentle cooling mode temperature zone. This is particularly effective in the case when one goes to bed, and healthy drying with suppression of chillness can be obtained.

We claim:

1. An air conditioner comprising a freezing cycle circuit including, successively provided on a main duct line in a mentioned order, a compressor, a four-way valve, an external heat exchanger, a pressure reducer, an internal heat exchanger array, said main duct line branching into at least an upper part and a lower part coolant flow line in said internal heat exchanger array, said upper part coolant flow line having a greater length than said lower part coolant flow line, and an on-off valve provided on said upper part coolant flow line and closed in a low capacity cooling operation.

2. The air conditioner according to claim 1, wherein said on-off valve is provided on a portion of said upper part coolant flow line on a inlet side in a cooling operation.

3. An air conditioner comprising a freezing cycle circuit including, successively provided on a main duct line in a mentioned order, a compressor, a four-way valve, an external heat exchanger, a pressure reducer, an internal heat exchanger array, said main duct line branching into at least an upper part and a lower part coolant flow line in said internal heat exchanger array, the length of a portion of said lower part coolant flow line on a side of a lower end of said heat exchanger array being less than the length of the other portion, and an on-off valve provided on said upper part coolant flow line and closed in a low capacity cooling operation.

4. The air conditioner according to claim 3, wherein a less length portion of said lower part coolant flow line is made up for by leading a portion of said upper coolant flow line to the lower end of said heat exchanger array.

5. A method of controlling an air conditioner which comprises a freezing cycle circuit including, successively provided on a main duct line in a mentioned order, a compressor, a four-way valve, an external heat exchanger, an electronic expansion valve as a pressure reducer and an internal heat exchanger array, a controller for controlling said freezing cycle circuit according to signals from a temperature sensor and a predetermined temperature detector, said main duct line branching at least into an upper part and a lower part coolant flow in said internal heat exchanger array, and on-off valve provided on said upper part coolant flow line and closed in a low capacity cooling operation, said method having a gentle cooling mode for gently cooling a room while a temperature thereof is held in a neighborhood of a predetermined temperature, and a gentle drying mode for gently drying said room while substantially holding a prevailing temperature thereof, in addition to a cooling mode and a heating mode, said on-off valve being closed by said controller when said gentle cooling mode is selected, said controller controlling said electronic expansion valve to increase a capacity thereof when closing said on-off valve.

6. A method of controlling an air conditioner which comprises a freezing cycle circuit including, successively provided on a main duct line in a mentioned order, a compressor, a four-way valve, an external heat exchanger, a pressure reducer and an internal heat exchanger array, a controller for controlling said freezing cycle circuit according to signals from a temperature sensor and a predetermined temperature detector, said main duct line branching at least into an upper part and a lower part coolant flow line in said internal heat exchanger array, and an on-off valve provided on said upper part coolant flow line and closed in a low capacity cooling operation, said method having a gentle cooling mode for gently cooling a room while a temperature thereof is held in a neighborhood of a predetermined temperature, in addition to a cooling mode and a heating mode, when said gentle cooling mode is selected, said controller setting a plurality of temperature zones with predetermined temperature ranges with reference to predetermined temperatures and closing said on-off valve when a temperature of the room is in a gentle cooling temperature zone lower than a predetermined temperature for a predetermined period of time.

7. The air conditioner control method according to claim 6, wherein when said air conditioner is in a quick freezing mode, said gentle cooling mode is not brought about until reaching of a neighborhood of a predetermined temperature of said quick cooling mode in the room.

8. The air conditioner control method according to claim 6, wherein said on-off valve is closed under a further condition that an operating frequency of said compressor is too low to provide a cooling capacity.

9. The air conditioner control method according to claim 6, wherein said pressure reducer is an electronic expansion valve, said controller controlling said electronic expansion valve to increase a cooling capacity thereof when closing said on-off valve.

10. The air conditioner control method according to claim 6, wherein said on-off valve is an electromagnetic valve, and when the temperature of the room is reduced to be lower than said gentle cooling temperature zone, said controller outputs a compressor stop signal and, after a subsequent predetermined period of time, de-energizes said electromagnetic expansion valve to open said on-off valve.

11. The air conditioner control method according to claim 8, wherein said controller opens said on-off valve when the temperature of the room has been in a temperature zone higher than a predetermined temperature for a predetermined period of time, said controller opens said on-off valve.

12. The air conditioner control method according to claim 11, wherein when said on-off valve is opened, the operating frequency of said compressor is returned to the frequency in the cooling mode.

13. A method of controlling an air conditioner which comprises a freezing cycle circuit including, successively provided on a main duct line in a mentioned order, a compressor, a four-way valve, an external heat exchanger, a pressure reducer and an internal heat exchanger array, a controller for controlling said freezing cycle circuit according to signals from a temperature sensor and a predetermined temperature detector, said main duct line branching at least into an upper part and a lower part coolant flow line in said internal heat exchanger array, and an on-off valve provided on said upper part coolant flow line and closed in a low capacity cooling operation, said method having a gentle cooling mode for gently cooling a room while a temperature thereof is held in a neighborhood of a predetermined temperature, and a gentle drying mode for gently drying said room while substantially holding a prevailing temperature thereof, in addition to a cooling mode and a heating mode, said on-off valve being closed by said controller when said gentle cooling mode is selected, when said gentle drying mode is selected, said controller setting a plurality of temperature zones with predetermined temperature ranges with reference to a temperature of the room at this time and operating frequencies of said compressor for said respective temperature zones, and driving said compressor at an operating frequency for a temperature zone, in which the temperature of the room prevails.

14. The air conditioner control method according to claim 13, wherein the temperature ranges of said temperature zones and the operating frequencies of said compressor are different with reference to a reference atmospheric temperature.

15. The air conditioner control method according to claim 14, wherein when an actual atmospheric temperature is high than said reference atmospheric temperature, the temperature range is greater than that when the actual atmospheric temperature is lower.

16. The air conditioner control method according to claim 13, wherein the operating frequency of said compressor is changed with a temperature zone after a predetermined waiting time.

* * * * *